US005123854A

United States Patent [19]

Petersen et al.

[11] Patent Number: 5,123,854

[45] Date of Patent: Jun. 23, 1992

[54] SHUNTED ELECTRICAL CONNECTOR

[75] Inventors: Bruce A. Petersen, Schaumburg; Gary L. Tomczak, Woodridge, both of Ill.

[73] Assignee: Molex Incorporated, Lisle, Ill.

[21] Appl. No.: 668,645

[22] Filed: Mar. 13, 1991

[51] Int. Cl.[5] ..... H01R 29/00; H01R 31/08

[52] U.S. Cl. ..... 439/188; 439/507; 439/516; 439/885; 29/874; 29/884

[58] Field of Search ..... 439/188, 507, 511, 516, 439/676, 885, 513; 29/874, 884

[56] References Cited

U.S. PATENT DOCUMENTS 4,274,691 6/1981 Abernethy et al. ..... 439/188
4,501,459 2/1985 Chandler et al. ..... 439/188
4,552,423 11/1985 Swengel, Jr. ..... 439/507
4,671,599 6/1987 Olsson ..... 439/188
4,895,532 1/1990 Bogese, II ..... 439/507
5,030,123 7/1991 Silver ..... 439/507

*Primary Examiner*—Paula A. Bradley
*Attorney, Agent, or Firm*—Stephen Z. Weiss

[57] ABSTRACT

A shunting system for a modular jack type connector which includes a dielectric housing defining a plug receiving cavity open at one end of the housing. A plurality of terminals are mounted in the housing, with contact portions disposed in a single row. A pair of programmable shunts substantially identically stamped and differently formed from sheet metal material are provided for engagement with the contact portions when the two shunts are mounted in different positions on the housing. Selected different ones of the contact fingers of each shunt are removed so that the remaining contact fingers engage only selected ones of the contact portions.

5 Claims, 2 Drawing Sheets

SHUNTED ELECTRICAL CONNECTOR

FIELD OF THE INVENTION

This invention generally relates to the art of electrical connectors and, particularly, to a shunted electrical connector of the modular jack type.

BACKGROUND OF THE INVENTION

There are a variety of known shunted electrical connectors, including connectors of the modular jack type, wherein selected different terminals of the connector are shunted or shorted for various proposals. Examples of such connectors are shown in U.S. Pat. No. 4,274,691 to Abernethy, dated Jun. 21, 1981; U.S. Pat. No. 4,552,423 to Sweugel, dated Nov. 12, 1985; U.S. Pat. No. 4,863,393 to Ward et al., dated Sept. 5, 1989; and U.S. Pat. No. 4,874,333 to Reed, dated Oct. 17, 1989. All of these patents show one form or another of a modular jack type connector which includes such components as shorting elements, bridging cards, shunting strips and the like to shunt or short selective different terminals of the connectors, particularly when the connectors are not receiving a mating connector plug. For instance, the shunting elements may be used to maintain line continuity when no plug is inserted into the jack.

Generally, electrical connectors of the character described include "spring beam contacts" which protrude from a portion of the jack housing into the plug receiving cavity of the jack, the contacts or terminals being separated from each other by molded walls of the jack. The terminals include terminal portions, usually in the form of terminal pins for mating with the terminals of a complementary electrical component. For instance, the terminal pins may form solder tails for insertion into holes in a printed circuit board. In some instances, the terminal pins or solder tails are arranged in a single row, and in many other instances the terminal pins or solder tails are arranged in two rows.

The Sweugel '423 patent discloses a shunting strip which is programmable to shunt selective different terminals in a given row. The strip is fabricated from sheet metal and includes a web portion from which a series of individual contact fingers have been stamped to lie adjacent the plane of the web portion. The shunt is secured in the jack housing, with preselected individual contact fingers having been bent to project out of the plane of the web into the jack cavity and into engagement with free end portions of the spring beam contacts, thereby to common the terminals when a plug is not received in the jack cavity. The unselected contact fingers remain adjacent the plane of the web portion of the stamped and formed shunt.

One of the problems with programmable shunted electrical connectors as shown in the Sweugel '423 patent is that the programmable shunt is very specifically formed and is designed to shunt selective terminals in a single row. If the terminals of a modular jack are to be arranged in two rows, as is quite common, a different sized and shaped shunting strip must be fabricated, adding significantly to the overall assembly costs of the jack connector. More importantly, the shunting strip can shunt only one combination of terminals. For instance, the shunting strip could shunt terminals 1, 2, 4 and 6 in a given row. However, the strip could not shunt terminals 1 and 2 independent of shunting terminals 4 and 6.

The present invention is directed to solving the above problems by providing a modular jack type connector with programmable shunting means in the form of a shunting strip stamped of a given size and shape and which can be formed in different configurations to shunt independent configurations of terminals.

SUMMARY OF THE INVENTION

An object, therefore, of the invention is to provide a modular jack type connector with a new and improved shunting means.

More particularly, the jack connector includes a dielectric housing means defining a plug receiving cavity which is open at a plug receiving mouth at one end of the housing means. A plurality of terminals are mounted in the housing. The terminals include terminal portions such as terminal pins or solder tails, disposed in two rows, with contact portions of the terminals extending in cantilever fashion in a single row within the plug receiving cavity.

The invention contemplates a pair of programmable shunts substantially identically sized and stamped and differently formed from sheet metal material. Each shunt includes a web and a series of contact fingers projecting from the web. One shunt is mounted at a first position on the jack housing, with the contact fingers thereof in engagement with a first selected combination of the contact portions, and the other shunt is mounted on the housing at a second position, with the contact fingers thereof in engagement with a second selected combination of the contact portions.

Each of the two shunts are programmed for a given jack circuitry by removing selected different contact fingers of the respective shunt so that the remaining contact fingers engage only selected ones of the contact portions of the terminals.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
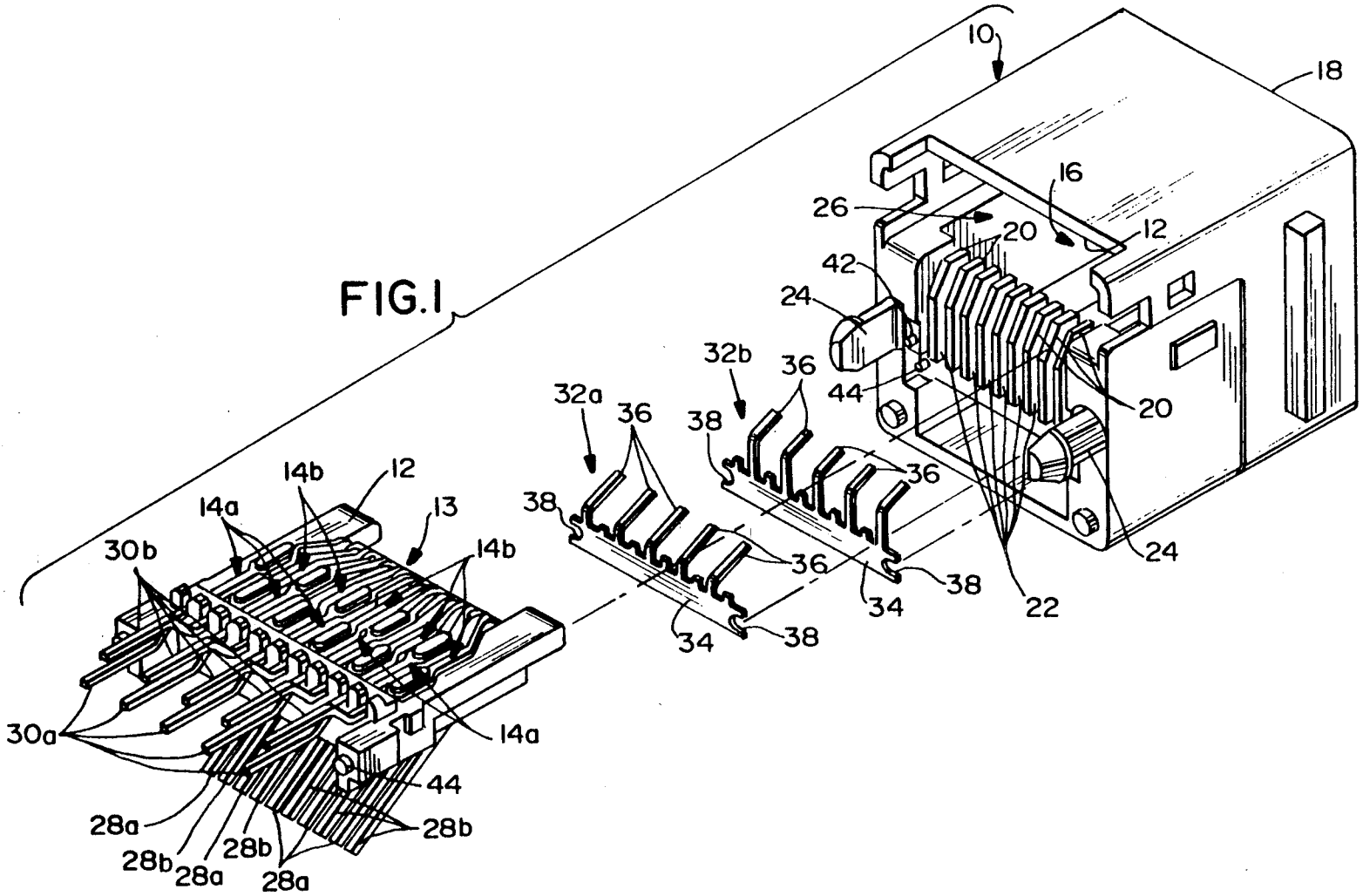
FIG. 1 is an exploded perspective view of a modular jack type connector incorporating the novel shunting means of the invention.

Referring to the drawings in greater detail, and first to FIG. 1, the invention is embodied in a modular jack type connector which includes a two-part housing means. The housing means include a first part in the form of a modular jack housing, generally designated 10, and a second part 12 which is a component of an insulator subassembly, generally directed 13, including a plurality of terminals, generally designated 14*a* and 14*b*.

Housing 10 is a unitarily molded component of dielectric material, such as plastic or the like. As is known in the art, the housing defines a plug receiving cavity, generally designated 16, open at a plug receiving mouth at one end 18 of the housing. The cavity is sized and shaped for receiving a complementary jack plug connector which is inserted into cavity 16 from the open or mating end 18 of the housing. A plurality of partitions 20 are molded integrally with housing 10 to define slots 22 therebetween for receiving spring contact portions of terminals 14*a* and 14*b*, as described hereinafter. Housing 10 further includes a pair of mounting pegs 24 for surface mounting the connector through appropriate holes in a printed circuit board, as is known in the art.

Housing component 12 is unitarily molded of dielectric material, such as plastic or the like, and is shaped in the form of a housing plug for insertion through a mouth 26 at the top of housing 10. Component 12 is fabricated separate from housing 10 to facilitate assembly of terminals 14*a* and 14*b* within the two-part housing means. Specifically, the terminals are assembled to housing component 12 to form subassembly 13, as seen at the left-hand end of FIG. 1, and the subassembly is inserted through a mouth 26 of housing 10 so that the terminals are substantially within the insulating housing, and with spring contact portions 28*a* of terminals 14*a* and spring contact portions 28*b* of terminals 14*b* alternately disposed in slots 22 between partitions 20. It can be seen that spring contact portions 28*a* and 28*b* are coplanar or in a single row.

Terminals 14*a* and 14*b* also have terminal portions 30*a* and 30*b*, respectively. The terminal portions form terminal pins or solder tails of the terminals and are insertable through appropriate holes in a printed circuit board (not shown). Whereas spring contact portions 28*a* and 28*b* of terminals 14*a* and 14*b*, respectively, are in a single row, it can be seen that terminal portions 30*a* and 30*b* of terminals 14*a* and 14*b*, respectively, are offset and alternate in two distinct rows.

The invention contemplates providing shunt means for the modular jack connector, the shunt means providing shorting for selected different combinations of terminals 14*a* and 14*b*. Notwithstanding the fact that terminal pins 30*a* and 30*b* of terminals 14*a* and 14*b*, respectively, are disposed in two different rows, the invention contemplates that a pair of shunting strips can be fabricated in an identical original shape and subsequently formed and programmed for mounting on housing parts 10 at different positions to shunt discrete or independent combinations of terminals which form the two rows of terminal pins.

More particularly, FIG. 1 shows a pair of shunt strips, generally designated 32*a* and 32*b*. The shunt strips are provided for shunting selected ones of terminal pins 30*a*, 30*b* of terminals 14*a*, 14*b* by engaging the respective spring contacts 28*a*, 28*b*, as described hereinafter.

Figure 2:
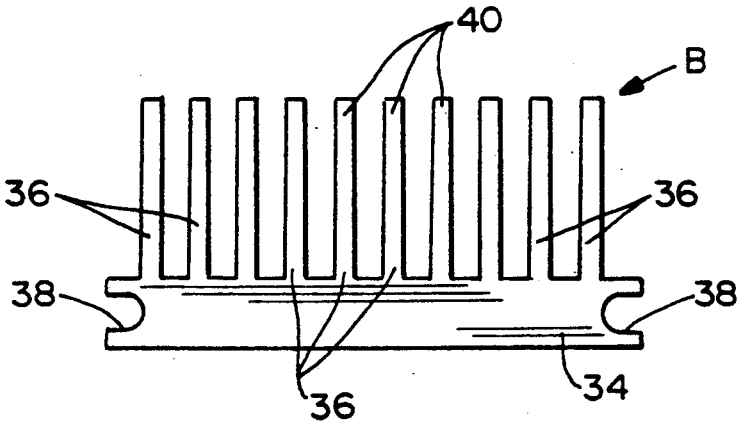
FIG. 2 is a plan view of a blank from which the shunts of the connector are formed.

Referring to FIG. 2 in conjunction with FIG. 1, shunt strips 32*a* and 32*b* are fabricated of stamped and formed sheet metal material. A blank, generally designated "B", is stamped from a continuous strip of sheet metal. This blank will be formed in the shape of shunt strips 32*a* and 32*b* (FIG. 1). Specifically, the blank includes a web 34 having a series of contact fingers 36 coplanar therewith and projecting from one side thereof. Opposite ends of the web are formed with recesses 38. Contact fingers 36 may have gold plated distal ends, as at 40. Preferably, only the side of the contact fingers which will engage spring contact fingers 28*a* and 28*b* of terminals 14*a* and 14*b*, respectively, are plated. It should be understood that this single, identically sized and shaped blank "B" (FIG. 2) is used to form both shunt strips 32*a* and 32*b*.

To that end, referring back to FIG. 1, housing 10 has a pair of integrally molded mounting bosses 42 over which recesses 38 of shunt strip 32*a* are press-fit to mount shunt strip 32*a* onto the housing. It should be noted that only the left-hand mounting boss 42 is visible in FIG. 1, but an identical boss is identically positioned behind the right-hand mounting peg 24 in the depiction. A similar pair of mounting bosses 44 are integrally molded on housing 10 for mounting shunt strip 32*b*, with the recesses 38 thereof press-fit over bosses 44. It can be seen in FIG. 1 that mounting bosses 42 are vertically and horizontally spaced from mounting bosses 44 in order to distinctly separate shunt strips 32*a* and 32*b*.

In comparing shunt strips 32*a* and 32*b* shown in FIG. 1 with blank "B" shown in FIG. 2, it can be seen that some of the contact fingers 36 of each shunt strip have been removed. In fact, it can be seen that each alternating contact finger of each respective shunt strip has been removed, and in comparing the two shunt strips, the alternatingly disposed contact fingers longitudinally of the respective shunt strips have been removed relative to each other. In this manner, the remaining contact fingers 36 of shunt strip 32*a* are longitudinally disposed for engagement with spring contact portions 28*a* of terminals 14*a*, and contact fingers 36 of shunt strip 32*b* are longitudinally disposed for engagement with spring contact portions 28*b* of terminals In addition, it can be seen that contact fingers 36 of shunt strip 32*a* are bent or formed out of the plane of web 34 at points closer to the web than are contact fingers 36 of shunt strip 30*b*. This will be explained below in relation to FIGS. 3 and 4.

In comparing contact portions 28*a* and 28*b* of terminals 14*a* and 14*b*, respectively, with shunt strips 32*a* and 32*b*, it should be noted that there are ten terminals with five terminal pins in each row as illustrated at the left of FIG. 1. Consequently, each shunt strip 32*a* and 32*b* originally has ten contact fingers 36 for potential engagement with any one of the terminal contact portions. However, FIG. 1 shows that only selected ones of contact fingers 36 are provided for engaging the respective spring contact portions 28*a* or 28*b* of terminals 14*a* or 14*b*. Specifically, FIG. 1 shows that shunt 32*a* has (starting from the left) the "1st", "3rd" and "5th" contact fingers projecting from web 34. Shunt 32*b* has the "8th" and "10th" contact fingers projecting from its web 34. All of the remaining contact fingers of both shunts have been severed from the webs. Therefore, each shunt is capable of shunting a discrete or independent combination of terminals 14*a* or 14*b* by engaging respective selected ones of the contact portions of the terminals when a complementary plug is not positioned in modular jack housing 10. The illustration in FIG. 1 is but an example.

Figure 3:
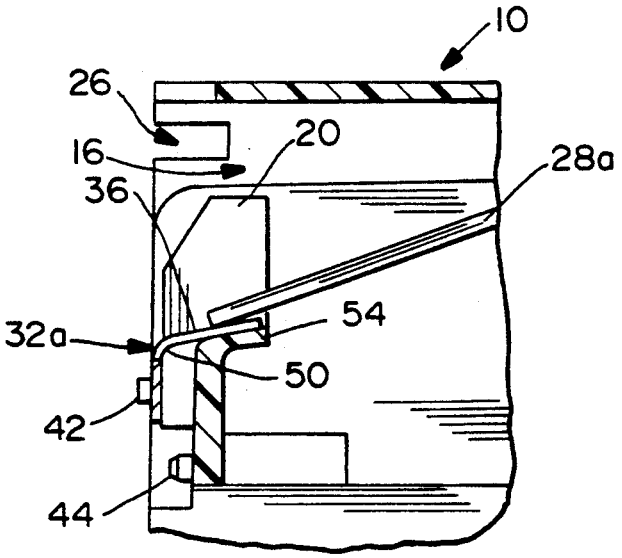
FIG. 3 is a fragmented section through a portion of the connector housing, illustrating the position of one of the shunts of the connector.
Figure 4:
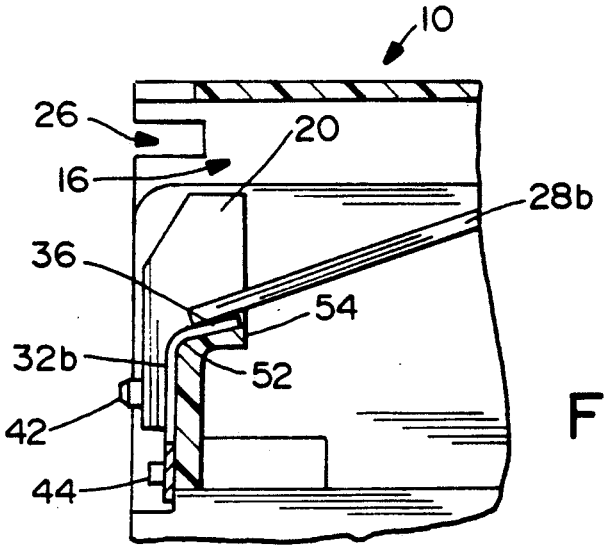
FIG. 4 is a view similar to that of FIG. 2, illustrating the position of the other of the shunts of the connector.

FIGS. 3 and 4 show how the differently formed shunt strips 32*a* and 32*b* (from an identical blank "B") are staked on mounting bosses 42 and 44 of housing 10 so that the contact fingers 36 of both shunt strips are coplanar for engagement with the single row of spring contact portions 28*a* and 28*b* of terminals 14*a* and 14*b*. More particularly, it can be seen in FIG. 3 that shunt strip 32*a* is mounted on bosses 42, the bosses being disposed higher and outwardly of bosses 44. Consequently, contact fingers 36 of shunt strip 32*a* are bent, as at 50, so that the contact fingers are relatively long to project inwardly a sufficient distance to underlie and engage spring contact portions 28*a* of respective terminals 14*a*.

FIG. 4 shows shunt strip 32*b* mounted on bosses 44 of housing 10. It can be seen that bosses 44 are disposed below bosses 42 and inwardly thereof relative to the housing. Consequently, shunt strip 32*b* is bent, as at 52, to form shorter contact fingers 36 for engagement with spring contact portions 28*b* of the respective terminals 14*b*. It can be seen in FIGS. 3 and 4 that, notwithstanding the fact that the shunt strips are mounted at different positions on housing 10, all of the spring fingers 36 of both shunt strips are coplanar for engagement with the selected spring contact portions 28*a* and 28*b* which are in a single row, or coplanar. Preferably, housing 10 has a flange 54 (FIGS. 3 and 4) at the bottom of the slots defined by partitions 20 and on top of which the contact fingers of the two shunt strips are in engagement. This provides an anti-stress feature for the contact fingers against which spring contact portions 28*a* and 28*b* are in engagement.

From the foregoing, it can be seen that a shorting means or system: has been provided by the invention wherein shorting strips can be fabricated in identical original stamped configurations (i.e., blank "B" in FIG. 2) and then subsequently formed as shown in FIGS. 1, 3 and 4 to shunt different and independent combinations of terminals. The originally, identically stamped shunt strips can be individually programmed by removing selected contact fingers 36 so that each shunt strip can be individually programmed to shunt selected ones of the terminals in that row. The shunt strips are very simply staked by a press-fit onto their respective bosses 42 and 44 of housing 10, and the subassembly of housing component 12 and terminals 14*a*, 14*b* is inserted into mouth 26 of housing 10 to provide a very simple programmable modular jack connector, with the programmed contact fingers in shunting engagement with the selected different spring contact portions of the terminals as illustrated in FIGS. 3 and 4.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a modular jack type connector which includes a dielectric housing means defining a plug receiving cavity open at one end of the housing means, a plurality of terminals mounted on the housing with contact portions extending in cantilever fashion in a single row within the plug receiving cavity, a pair of programmable shunts substantially identically stamped and differently formed from sheet metal and each comprising a web and a series of contact fingers projecting from the web whereby the contact fingers of each respective shunt are engageable with the contact portions of the terminals, selected ones of the contact fingers of each shunt having been removed so that the remaining contact fingers engage only selected ones of the contact portions to provide independently programmable shunting means.

2. In a modular jack type connector as set forth in claim 1, including interengaging mounting means between the dielectric housing and each shunt spacing the shunts for engagement of their programmed contact fingers with the contact portions of the terminals.

3. In a modular jack type connector as set forth in claim 2, wherein the contact fingers of one shunt are bent at first positions relative to the web thereof and the contact fingers of the other shunt are bent at second positions relative to the web thereof, different from the first positions of the one shunt, whereby the contact fingers lie in a single row notwithstanding the spacing of the shunts on the housing means.

4. A method of fabricating a shunted modular jack type connector which includes a dielectric housing means defining a plug receiving cavity open at one end of the housing means, and a plurality of terminals mounted in the housing with contact portions disposed in a single row extending in cantilever fashion within the plug receiving cavity, comprising the steps of:

stamping a pair of substantially identical blanks from sheet metal material including a series of contact fingers in a single row;

forming the two blanks so that the respective contact fingers thereof are in different positions but engageable with the single row of contact portions when the stamped and formed blanks are mounted at different positions on the housing means;

removing selected ones of the contact fingers of each blank so that the remaining contact fingers engage only selected ones of the contact portions; and mounting the stamped, formed and finger-removed blanks at said different positions on the housing means.

5. The method of claim 4 wherein said forming step comprises bending the contact fingers of each respective shunt at different respective locations, whereby the bent contact fingers of each blank are in a common plane when mounted at said different positions on the housing means.

* * * * *